US007939144B2

(12) United States Patent
Verleyen

(10) Patent No.: US 7,939,144 B2
(45) Date of Patent: May 10, 2011

(54) ARTIFICIAL TURF

(75) Inventor: Marc Verleyen, Desselgem-Waregem (BE)

(73) Assignee: Mattex Leisure Industries, Dubai (AE)

( * ) Notice: Subject to any disclaimer, the term of this patent is extended or adjusted under 35 U.S.C. 154(b) by 1124 days.

(21) Appl. No.: 10/564,254

(22) PCT Filed: Jul. 8, 2004

(86) PCT No.: PCT/EP2004/007631

§ 371 (c)(1),
(2), (4) Date: Mar. 6, 2006

(87) PCT Pub. No.: WO2005/005731

PCT Pub. Date: Jan. 20, 2005

(65) Prior Publication Data

US 2006/0159917 A1 Jul. 20, 2006

(30) Foreign Application Priority Data

Jul. 14, 2003 (WO) ..... PCT/EP03/07737

(51) Int. Cl.
*B32B 9/00* (2006.01)

(52) U.S. Cl. ..... 428/17; 428/95

(58) Field of Classification Search ..... 428/17, 428/95

See application file for complete search history.

(56) References Cited

U.S. PATENT DOCUMENTS

| | | | |
|---|---|---|---|
| 3,837,980 | A | 9/1974 | Nishimura et al. |
| 3,940,522 | A | 2/1976 | Wessells |
| 5,811,040 | A | 9/1998 | Mallonee |
| 5,922,462 | A | 7/1999 | Kent et al. |
| 5,958,527 | A | 9/1999 | Prevost |

FOREIGN PATENT DOCUMENTS

| | | |
|---|---|---|
| EP | 0 530 489 A1 | 7/1992 |
| JP | 02-240303 | 9/1990 |
| JP | 05-025806 | 2/1993 |
| JP | 07-082704 | 3/1995 |

*Primary Examiner* — David R Sample
*Assistant Examiner* — Daniel Miller
(74) *Attorney, Agent, or Firm* — Hoffmann & Baron, LLP

(57) ABSTRACT

An artificial turf filament has a cross-section that includes a central area and two wing areas integral with said central area. Further a bundle of a plurality of artificial turf filaments is proposed, wherein the artificial turf filaments are held together by one or more wrapping filaments wrapped around said artificial turf filaments. The wrapping filaments cross each other at cross points, and are bonded, preferably releasable bonded, to one another at said cross points. Also the wrapping filaments are bonded, preferably releasable bonded, to said artificial turf filaments.

25 Claims, 3 Drawing Sheets

ARTIFICIAL TURF

CROSS-REFERENCE TO RELATED APPLICATIONS

This application is the National Stage of International Application No. PCT/EP2004/007631, filed Jul. 8, 2004, which claims the benefit of International Application No. PCT/EP03/07737, filed Jul. 14, 2003, the contents of which is incorporated by reference herein.

FIELD OF THE INVENTION

A first aspect of the present invention relates to an improved artificial turf filament.

BACKGROUND OF THE INVENTION

Artificial turfs are known for indoor and outdoor use, primarily as a landscaping, recreational or sports surface.

Conventional artificial turf structures include a substrate onto which artificial turf filaments are anchored. The structure further commonly comprises a weather-resistant, cushioned backing. The filaments are commonly heavy denier synthetic polymer filaments simulating natural grass.

Conventional synthetic artificial turf filaments have a rectangular or oval cross-section.

U.S. Pat. No. 6,432,505 discloses other artificial turf filaments, having a rounded or oval cross-section as well as filaments having a diamond shaped cross-section.

U.S. Pat. No. 4,356,220 discloses filaments having rectangular cross-section, as well as having a circular or triangular cross-section.

U.S. Pat. No. 6,495,236 discloses hollow tubular filaments for artificial turf, said filaments being anchored to a substrate so that U-shaped tubes are formed.

JP 9111532 discloses an artificial turf filament with an essentially rectangular cross-section having longitudinal ribs on the opposed main faces.

SUMMARY OF THE INVENTION

The first aspect of the present invention aims to provide an improved artificial turf filament.

A further object of the first aspect of the present invention is to provide an artificial turf filament having an improved lifetime.

Yet another object of the first aspect of the present invention is to provide an artificial turf filament suitable for ball sports, in particular soccer.

The first aspect of the present invention provides an artificial turf filament, wherein the cross-section of the filament has a central area and two wing areas on opposite sides of said central area and integral with said central area, said wing areas being arranged in a diverging orientation.

Preferably the filament is fortified by:

- the central area of the filament having a thickness greater than the thickness of the wing areas, and/or
- the filament, preferably the central area, containing one or more reinforcement fibres.

The invention is based on the insight that thus shaped cross-section results in an advantageous behaviour or the filaments as the filaments are mechanically loaded. In particular the resilient behaviour of the filament after deformation, e.g. after being stepped on, is improved. Also the behaviour of the artificial turf is improved as one considers a ball rolling over the turf, e.g. in soccer. The cross-section allows for a roll behaviour of a (soccer) ball closely resembling the rolling of said ball over a well-maintained natural grass surface. The artificial turf filament combines a good resistance against repeated deformation with durable flexibility.

Preferably the central area of the filament has a thickness greater than the thickness of the wing areas, at least of a part of each wing area adjoining said central area. In this manner the central area forms a stem.

Preferably the central area of the filament has a thickness at least 50%, preferably at least 100%, greater than the thickness of the wing areas, at least of a part of each wing area adjoining said central area.

Further preferred embodiments of the artificial turf filament are disclosed in the subclaims and in the description that follows.

The first aspect of the present invention also relates to an artificial turf containing said artificial turf filaments.

Preferred embodiments of such an artificial turf are also disclosed in the subclaims and the description that follows.

The second aspect of the present invention relates to bundled artificial turf filaments.

In conventional artificial turf structures the turf comprises a substrate, commonly in the form of a carpet, with a multiplicity of artificial turf filaments anchored to said substrate.

Also conventionally a filling material, such as for example sand, rubber particles, etc, is deposited over the substrate and in between the filaments, so that the upper ends of the filaments extend above the layer of filling material. It is common to perform a brushing process in order to distribute the filling material over the substrate and bring it in the voids between the filaments.

In practice problems have been encountered when distributing the filling material over the artificial turf in order to create the filling material layer. In particular it has proved difficult to bring the filling material in the voids between the filaments.

U.S. Pat. No. 5,462,778 discloses an artificial turf having cut piles formed over the surface of a backing structure by implanting a multiplicity of tufts. Each tuft comprises one or a plurality of pile yarns. Each of the pile yarns is composed of a plurality of bundled flat filaments twisted and fixed in the twisted state into a slender form having an approximately spiral cross-section.

These known artificial turf bundles are likely to improve the distribution of the filling material over the turf when compared to turf structures having non-bundled filaments. However, these bundles loose their cohesion already during production of the carpet. Also these known bundles are difficult to produce and have unfavourable playing characteristics in sports.

The second aspect of the present invention aims to provide to improved bundled artificial turf filaments.

It is a further object of the second aspect of the present invention to provide an artificial turf including a multiplicity of bundled artificial turf filaments, wherein the distribution of a filling material over the turf can be effected without problems.

The second aspect of the invention provides a bundle of a plurality of artificial turf filaments, which is characterized in that the artificial turf filaments are held together by one or more wrapping filaments wrapped around said artificial turf filaments.

By using one or more wrapping filaments bundles of artificial turf filaments can be created efficiently in-line with the production process of the artificial turf filaments.

In a preferred embodiment said one or more wrapping filaments are bonded, preferably releasable bonded, to said artificial turf filaments.

In a practical embodiment the one or more wrapping filaments are synthetic polymer filaments and are bonded to each other and/or to the artificial turf filaments by a thermal bonding process.

In a highly preferred embodiment the one or more wrapping filaments are releasable bonded so that upon mechanical action, preferably a brushing process, the bonds are released.

The bundled artificial turf filaments can be manufactured by holding multiple artificial turf filaments next to one another while one or more wrapping filaments are wrapped around said artificial turf filaments.

It is then preferred that said one or more wrapping filaments are synthetic polymer filaments and are (releasable) bonded to each other and/or to the artificial turf filaments by a thermal bonding process.

In a practical embodiment of this manufacturing process the one or more wrapping filaments are heat treated before wrapping around said artificial turf filaments, so that the surface of the wrapping filament melts and the melted surface is brought against the artificial turf filaments as the one or more wrapping filaments are wrapped around said artificial turf filaments. If multiple wrapping filaments are present it is also possible that the melted surfaces of the wrapping filaments are fixed to each other at intersection points as the wrapping filaments are wrapped around said artificial turf filaments.

The second aspect of the invention further relates to an artificial turf comprising a substrate and a plurality of bundled artificial turf filaments having one or more wrapping filaments.

The second aspect of the present invention also relates to a method of preparation of an artificial turf, wherein said turf provided with bundled artificial turf filaments using wrapping filaments is subjected to a wrapping filaments release treatment effecting the release of the wrapping filaments from the artificial turf filaments.

It is highly preferred that—prior to effecting the release of the wrapping filaments—a filling material is deposited between the bundles of artificial turf filaments. Said filling material can preferably include rubber particles.

In a preferred method of production of an artificial turf a plurality of artificial turf filaments are produced and subsequently bundled by one or more wrapping filaments. The wrapped bundle of filaments is then wound on a spool. The wrapped bundle of filaments is subsequently supplied to the tufting machine, which produces the artificial turf containing the filaments.

By keeping the wrapped bundles of filaments more or less intact during the deposition of the filling materials on the artificial turf the voids between the bundles will be easily accessible for the filling material. Once the filling material has been distributed satisfactorily, the mechanical action, preferably brushing with a suitable brush, will cause the bonds of the wrapping filaments to release. Thereby the properties of the individual artificial turf filaments return.

It will be apparent to the man skilled in the art that the aspects of the invention can be used independent from one another but also in various combinations. Such a combination of filaments having a V shaped cross-section and the bundling of these filaments to allow for an improved deposition of the filling material is considered advantageous by the applicant.

BRIEF DESCRIPTION OF THE DRAWINGS

The aspects of the present invention will now be explained further referring to the drawings and the description that follows.

In the drawings

DETAILED DESCRIPTION OF PREFERRED EMBODIMENTS

Figure 1:
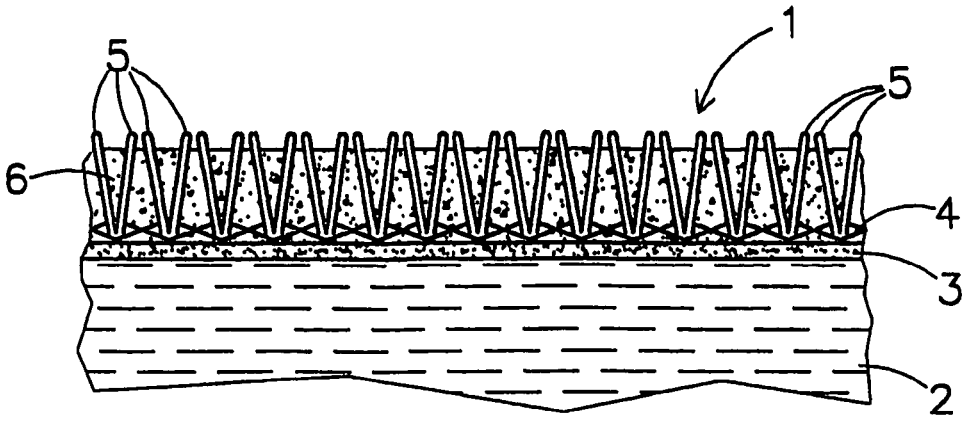
FIG. 1 shows in vertical cross-section a typical example of an artificial turf including filaments.

FIG. 1 shows a conventional artificial turf 1 placed on a stabilization and drainage layer 2. The turf 1 is of a carpet like structure and includes an elastic backing layer 3, a substrate 4 on top of said backing layer 3 and a multiplicity of artificial turf filaments 5, which can be tufted or the like onto the substrate 4. A layer 6 of filling material, such a for example sand and/or rubber particles or other particles, is present on top of the substrate 4. The upper ends of the filaments 5 extend above the surface of the filling layer 6.

Figure 2:
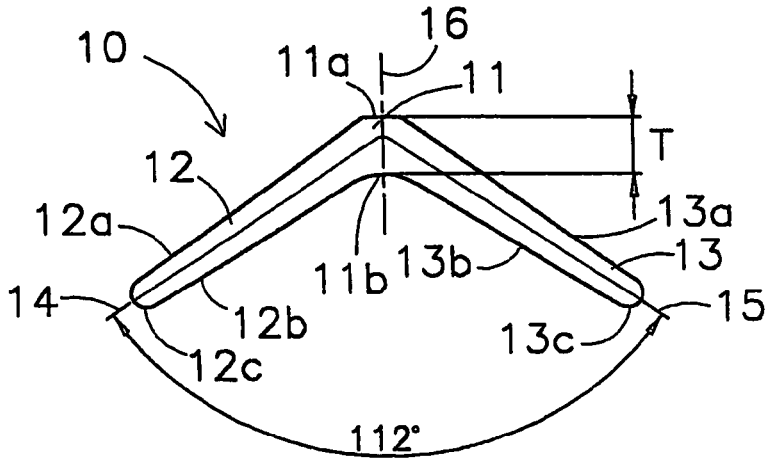
FIG. 2 shows a cross-sectional view of a first exemplary embodiment of the artificial turf filament according to the first aspect of the present invention.

FIG. 2 shows at right angles to the longitudinal extent thereof a synthetic polymer artificial turf filament 10 having a uniform cross-section over its length. These filaments 10 can replace the filaments 6 in the FIG. 1 embodiment of the turf 1.

The filament 10 has an essentially V-shaped cross-section, which consists of a central area 11 and two wing areas 12, 13, which are integral with said central area and have a diverging orientation with respect to one another.

The wing areas 12, 13 have an identical cross-section defined by two flat planar opposed faces 12*a*, 12*b* and 13*a*, 13*b*. Centrally between the opposed faces of each wing area 12, 13 an imaginary centre line 14, 15 can be recognized. The distance between the centre lines 14, 15 of the wing areas 12,13 is the greatest at the free ends of the wing areas 12, 13.

The opposed faces 12*a*, 12*b*, 13*a*, 13*b* of each wing 12, 13 define a thickness of the wing area at right angles to the centre line. This thickness of each wing area 12, 13 tapers from said central area 11 towards the free end of each wing 12, 13.

The central area 11 of the filament 10 has a thickness greater than the thickness of the wing areas 12, 13. As can be seen in FIG. 2 the central area 11 has—in the direction of a bisector 16 of both centre lines 14, 15 of the wing areas 12, 13—a dimension "T" which is greater than the thickness of the adjoining wing areas 12, 13.

In this embodiment the centre lines 14, 15 are straight and include an angle. The point of intersection of the two centre lines 14, 15 here falls within the central area 11 of the cross-section of the filament 10.

At the side of the diverging wing areas the central area 11 has a face 11*b* of a curved concave shape, merging flush into the adjacent flat planar faces 12*b*, 13*b* of the wing areas 12, 13.

At the side remote from the diverging wing areas 12, 13 the central area 11 has a face 11*a* which is flat and planar and thus forms a flattened apex of said V-shaped cross-section. The face 11*a* merges via preferably rounded edges into the adjacent flat planar faces 12*a*, 13*a* of each wing area 12, 13.

The wings 12, 13 here each have a rounded tip 12*c*, 13*c* at their free end.

In a practical embodiment the total area of the cross-section of the filament 10 is 0.1981 mm, which corresponds to 1902 dtex. In this embodiment the angle between centre lines 14, 15 is 112 degrees. The dimension T is 0.197 mm. The width of the filament across the centre of the tips 12*c*, 13*c* is 1.35 mm.

Figure 3:
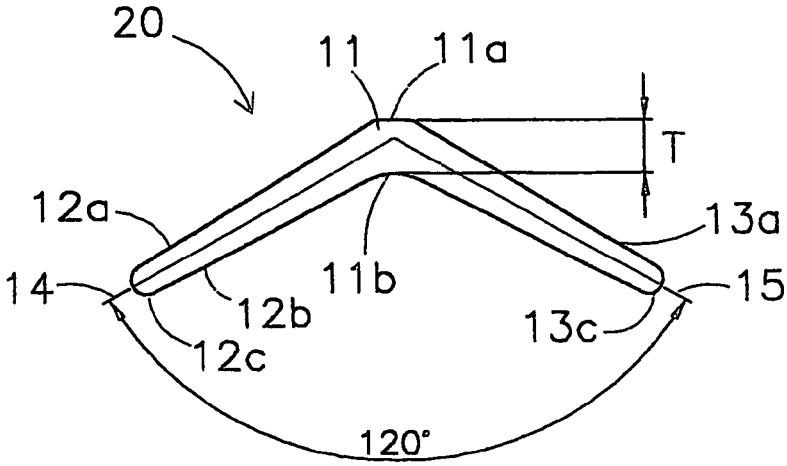
FIG. 3 shows a cross-sectional view of a second exemplary embodiment of the artificial turf filament according to the first aspect of the present invention.

FIG. 3 discloses a filament 20 having the same basic design of cross-section as the filament 10 in FIG. 2. Therefore similar parts are indicated with the same reference numerals.

The main difference is the angle between the centre lines 14, 15 which is 120 degrees in the embodiment of FIG. 3. The dimension T here is 0.13 mm. The total cross-sectional area is 0.1963 mm, resulting in 1885 dtex.

Figure 4:
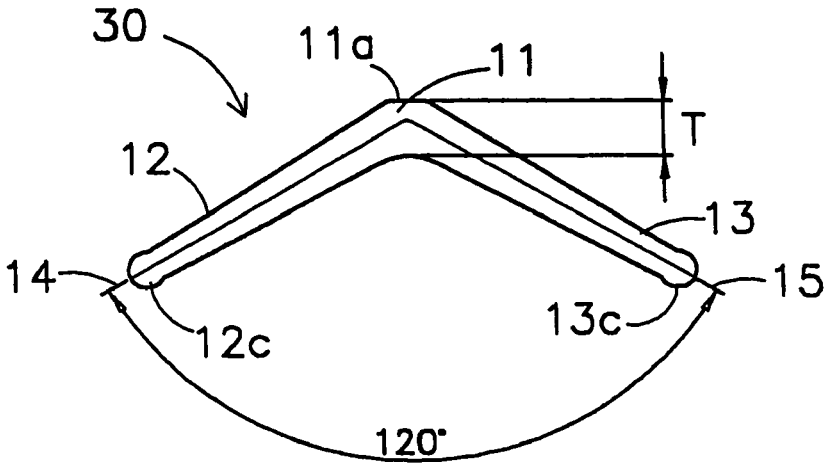
FIG. 4 shows a cross-sectional view of a third exemplary embodiment of the artificial turf filament according to the first aspect of the present invention.

FIG. 4 discloses a filament 30 having the same basic design of cross-section as the filament 20 in FIG. 3. Therefore similar parts are indicated with the same reference numerals.

The main difference is the design of the tips of the wing areas 12, 13. In FIG. 4 it can be seen that the tips 12*c*, 13*c* have an essentially circular cross-section having a diameter that is greater than the adjoining part of the wing area. In this embodiment the angle between the centre lines 14, 15 is 120 degrees as in the embodiment of FIG. 3. The dimension T here is 0.13 mm. The width between the centres of the tips 12*c*, 13*c* here is 1.32 mm. The total cross-sectional area is 0.1926 mm, resulting in 1849 dtex.

Figure 5:
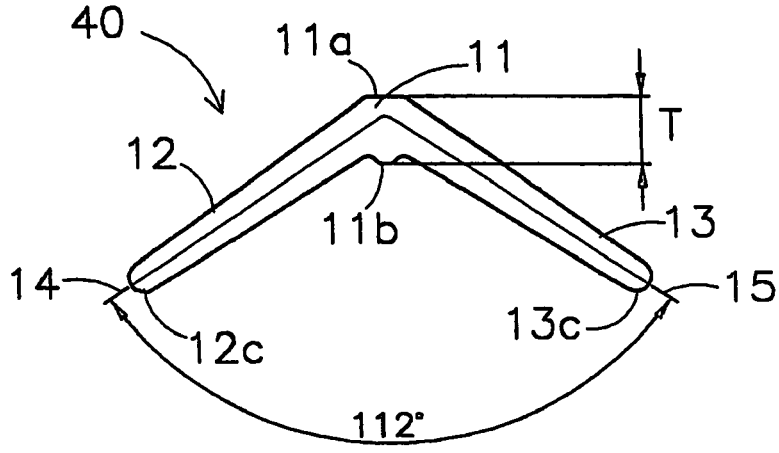
FIG. 5 shows a cross-sectional view of a fourth exemplary embodiment of the artificial turf filament according to the first aspect of the present invention.

FIG. 5 discloses a filament 40 having the same basic design of cross-section as the filament 10 in FIG. 2. Therefore similar parts are indicated with the same reference numerals.

The main difference is the design of the central area 11. Here the face 11*b* is not concave as in FIG. 2 but convex so that the face 11*b* of said central area 11 forms an outwardly protruding bulb. This results in a dimension T about 100% greater than the thickness of the adjoining wing areas 12, 13.

In this embodiment the angle between the centre lines 14, 15 is 112 degrees as in the embodiment of FIG. 2. The dimension T here is 0.167 mm. The width between the centres of the tips 12*c*, 13*c* here is 1.33 mm.

The total cross-sectional area is 0.1957 mm, resulting in 1878 dtex.

Figure 6:
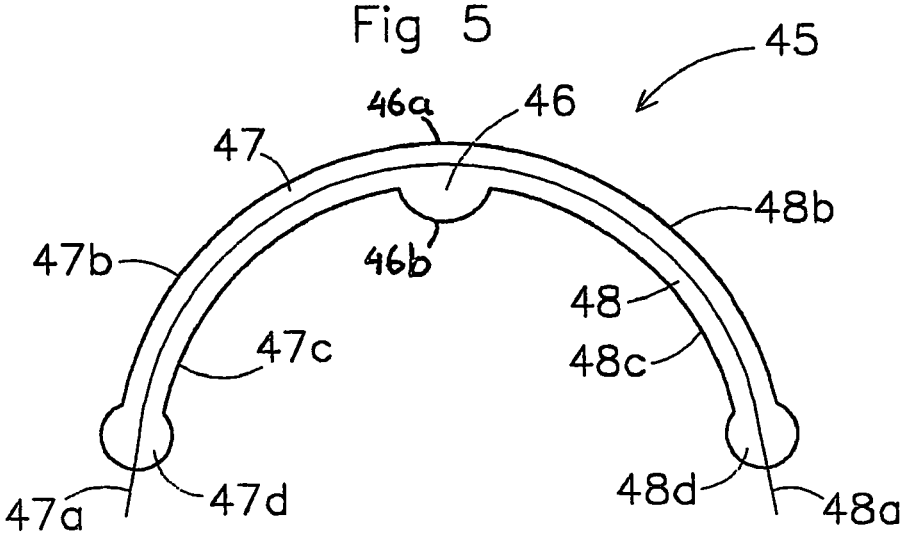
FIG. 6 shows a cross-sectional view of a fifth exemplary embodiment of the artificial turf filament according to the first aspect of the present invention.

FIG. 6 shows a filament 45 having a cross-section consisting of a central area 46 and two wing areas 47, 48. The wing areas 47, 48 each have a curved centre line 47*a*, 48*a*. The filament 45 has opposed faces 47*b*, 47*c* and 48*b*, 48*c*, in this example defining an essentially uniform thickness between the central area and the rounded tip 47*d*, 48*d* of increased radius. The central area 46 forms a protrusion 46*b* with respect to the faces 47*c*, 48*c* of the wing areas 47, 48, the other face 46*a* being essentially flush at the location of said central area 46.

By having the protrusion 11*b*, 46*b* in the middle part of the filament on the inside of the V or U-shape geometry of the filament, a situation is reached where the ability to bend of the filament is higher in one direction then from the other side. This means that when a ball rolls over the filament it will encounter less resistance when it hits the filament from the outside of the V or U-shape. When the artificial turf is produced on a tufting machine the filaments have a random direction. As a result, a rolling ball encounters filaments that bend easily and others that give more resistance. After intensive testing against relevant standards, it has been concluded that because of this randomness, a ball roll distance of between 6 m and 8 m is being reached.

Figure 7:
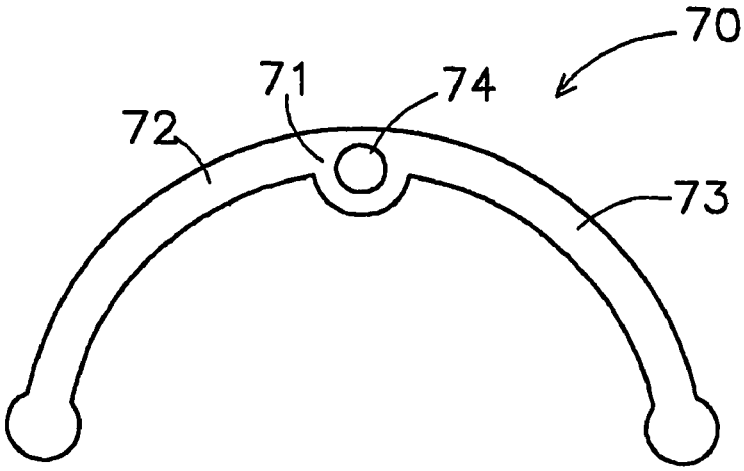
FIG. 7 shows a cross-sectional view of a sixth exemplary embodiment of the artificial turf filament according to the first aspect of the present invention.

FIG. 7 shows an alternative design of the filament wherein not only the central area 71 of the filament 70 has a thickness greater than the thickness of the wing areas 72, 73, but also a reinforcement fibre 74 is embedded in said central area 71.

In a practical embodiment said fibre 74 is a polyamide fibre whereas said fibre 74 is embedded in another polymer, such as polyethylene.

The reinforcement fibre 74 preferably has a higher E-modulus than the polymer in which it is embedded. The fibre can be embedded during the extrusion of the filament 70.

Referring to the FIG. 8 the second aspect of the invention will now be explained in detail.

Figure 8:
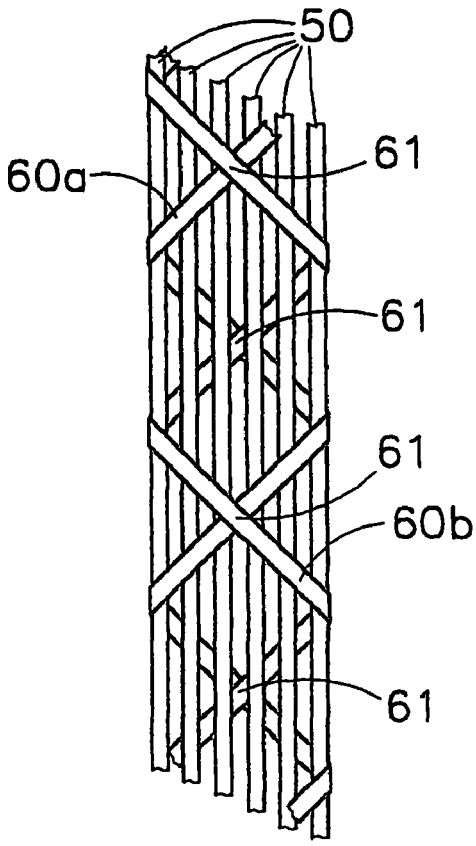
FIG. 8 shows a stage of the manufacturing of bundled artificial turf filaments according to the second aspect of the invention.

FIG. 8 shows a bundle of a plurality of artificial turf filaments 50, which filaments are preferably designed according to the first aspect of the present invention, e.g. filaments 10, 20, 30, 40, 45 or 70 as shown in FIGS. 2-7. It is noted that the second aspect of the invention is also applicable in combination with other filament designs, such as for example the prior art designs described earlier in this application.

The artificial turf filaments 50, in this example six filaments, are held together by one or more wrapping filaments 60 that are wrapped around said artificial turf filaments 50. In this example two wrapping filaments 60*a*, 60*b* are wrapped around said artificial turf filaments in a helical path, having opposite directions, so that the filaments 60*a*, 60*b* intersect each other at cross points 61. The filaments 60*a*, 60*b* are held in this example during the wrapping in a parallel orientation with respect to one another in a single flat plane.

At these cross points 61 the wrapping filaments 60*a*, 60*b* are bonded, in this example releasable bonded, to one another.

Also the wrapping filaments 60*a*, 60*b* are bonded, in this example releasable bonded, to said artificial turf filaments 50.

The bundle shown in FIG. 8 is preferably manufactured by wrapping heat treated synthetic polymer wrapping filaments 60*a*, 60*b* around the artificial turf filaments 50, which are preferably also heat treated. But with a suitable heat treatment the effect can be obtained that a thermal bonding occurs between the intersecting wrapping filaments 60*a*, 60*b* and (as is preferred) between the wrapping filaments 60*a*, 60*b* and the artificial turf filaments 50.

In particular it is envisaged that the wrapping filaments 60*a*, 60*b* are releasable bonded so that upon mechanical action, preferably a brushing process, the bonds are released. In practice the wrapping filaments 60*a*, 60*b* can be heated to a melting temperature at their surface so that the surface of the wrapping filaments sticks to the surface of the artificial turf filaments. This creates a bond that can be released later, as will be explained below.

In a practical production process the artificial turf filaments as well as the wrapping filaments can be subjected to a common heat treatment prior to the wrapping. It is then preferred that the wrapping filaments have a thickness which is less than the thickness of the artificial turf filaments, so that the wrapping filaments reach a higher temperature and the hot surface thereof will stick to the somewhat colder surface of the artificial turf filaments.

It will be apparent that the bundles as shown in FIG. 8 can be integrated into an artificial turf as in FIG. 1, wherein the conventional filaments 5 are replaced by bundled artificial turf filaments having wrapping filaments 60*a*, 60*b* around the artificial turf filaments 50.

The wrapping of the filaments 50 of course has an impact on the behaviour of the artificial turf. It is envisaged that the bond of the wrapping filaments is such that they easily release from the artificial turf bundles not during the production of the artificial turf carpet itself, but primarily after installation of said turf, in particular after the filling material has been deposited between the bundles. The bonds can be such that release is effected by normal use of the turf, e.g by playing a sport, such as soccer on it.

It is also envisaged, either as an alternative for normal use or in combination therewith that the turf is subjected to a wrapping filaments release treatment effecting the release of the wrapping filaments 60*a*, 60*b* from the artificial turf filaments 50 at least as far as the upper part of the bundles in the turf structure is concerned.

It is preferred that this wrapping filament release is only effected after a filling material 6 is deposited between the bundles of artificial turf filaments as in FIG. 1. In a practical process the filling material is distributed over the turf. As the voids between the bundles 50 are easily accessible for the filling material, the problems of the prior art are avoided. Then, preferably by suitable brushing, the wrapping filaments are released from the artificial turf filaments.

This method is in particular suitable when the filling material includes rubber particles, which gave rise to serious problems in the past.

What is claimed is:

1. An artificial turf filament, wherein the filament has in cross-section:

a central area having an inner side and an outer side, and two wing areas on opposite sides of said central area and integral with said central area, said wing areas being arranged in a diverging orientation from said inner side of said central area, wherein each wing area is defined by opposed faces, wherein at the inner side of the diverging wing areas the central area forms an outwardly protruding bulb forming a curved convex shape extending from said inner side between said two wings, so that said central area forms a protrusion with respect to the adjacent faces of the wing areas.

2. An artificial turf filament according to claim 1, wherein the filament, preferably the central area, is fortified by one or more reinforcement fibres.

3. An artificial turf filament according to claim 1, wherein the central area of the filament has a thickness at least 50%, preferably at least 100%, greater than the thickness of the wing areas, at least of a part of each wing area adjoining said central area.

4. An artificial turf filament according to claim 1, wherein the wing areas have a cross-section differing from one another.

5. An artificial turf filament according to claim 1, wherein the wings areas each have an essentially straight centre line.

6. An artificial turf filament according to claim 1, wherein the wing areas each have a curved centre line.

7. An artificial turf filament according to claim 1, wherein the distance between the centre lines of the wing areas is the greatest at the free ends of the wing areas.

8. An artificial turf filament according to claim 1, wherein the centre lines of the wing areas—if said centre lines are essentially straight—or imaginary lines interconnecting a centre point of said central area with a point where each of the centre lines intersects the free end of the wing area—if said centre lines are essentially curved—include an angle of less than 170 degrees.

9. An artificial turf filament according to claim 8, wherein said angle is between 90 and 170 degrees, preferably between 100 and 150 degrees, most preferably between 100 and 135 degrees.

10. An artificial turf filament according to claim 1, wherein the wing areas have a thickness measured at right angles to the associated centre line, and wherein the wing areas each have a thickness which tapers towards the free end of the wing.

11. An artificial turf filament according to claim 1, wherein the free end of each wing area has a rounded tip.

12. An artificial turf filament according to claim 11, wherein the rounded tip has a radius greater than a part of the wing area adjoining said rounded tip.

13. An artificial turf filament according to claim 1, wherein the filament contains at least one synthetic polymer.

14. An artificial turf filament according to claim 13, wherein the filament contains polyethylene.

15. An artificial turf filament according to claim 2, wherein the one or more reinforcement fibres are polyamide or PBT (polybuthylene therephtalate) fibres embedded in polyethylene or another polymer.

16. An artificial turf filament according to claim 1, wherein the filament contains an organic material.

17. An artificial turf including a plurality of artificial turf filaments according to claim 1.

18. An artificial turf having a substrate and a plurality of artificial turf filaments according to claim 1 anchored in the substrate and extending there from.

19. An artificial turf according to claim 18, wherein said filaments are injected into the substrate, and wherein the substrate is preferably soil.

20. An artificial turf according to claim 18, wherein said substrate is a carpet and said filaments are anchored to said carpet.

21. An artificial turf according to claim 18, wherein said artificial further includes a backing for said substrate, said filaments being anchored to said substrate.

22. An artificial turf filament according to claim 1, wherein said outer side has a flattened apex.

23. An artificial turf filament, wherein the cross-section of the filament has a central area having an inner side and an outer side and two wing areas on opposite sides of said central area and integral with said central area, said wing areas being arranged in a diverging orientation towards said inner side, said outer side having a flattened apex, wherein said inner side has an outwardly protruding bulb between said wing area.

24. An artificial turf filament according to claim 1, wherein said central area has a hole therethrough.

25. An artificial turf filament according to claim 1, wherein an outer surface of said outer side and outer surfaces of adjacent surfaces of each wing area have a flush transition therebetween.

* * * * *

UNITED STATES PATENT AND TRADEMARK OFFICE

CERTIFICATE OF CORRECTION

PATENT NO. : 7,939,144 B2
APPLICATION NO. : 10/564254
DATED : May 10, 2011
INVENTOR(S) : Marc Verleyen It is certified that error appears in the above-identified patent and that said Letters Patent is hereby corrected as shown below:

On the cover page, item (73), the printed patent incorrectly reads "...Assignee: Mattex Leisure Industries"; the patent should read --...Assignee: Ten Cate Thiolon B.V....--.

Signed and Sealed this
Twentieth Day of March, 2012

David J. Kappos

David J. Kappos
*Director of the United States Patent and Trademark Office*